United States Patent [19]

Lin et al.

[11] Patent Number: 4,624,012

[45] Date of Patent: Nov. 18, 1986

[54] METHOD AND APPARATUS FOR CONVERTING VOICE CHARACTERISTICS OF SYNTHESIZED SPEECH

[75] Inventors: Kun-Shan Lin; Alva E. Henderson; Gene A. Frantz, all of Lubbock, Tex.

[73] Assignee: Texas Instruments Incorporated, Dallas, Tex.

[21] Appl. No.: 375,434

[22] Filed: May 6, 1982

[51] Int. Cl.[4] ..... G10L 5/00

[52] U.S. Cl. ..... 381/51; 364/513.5; 381/52

[58] Field of Search ..... 381/29-53, 381/61; 364/513, 513.5

[56] References Cited

U.S. PATENT DOCUMENTS

| | | | |
|---|---|---|---|
| 3,158,685 | 11/1964 | Gerstman et al. | 381/52 |
| 3,681,756 | 8/1972 | Burkhard et al. | 381/36 |
| 3,704,345 | 11/1972 | Coker et al. | 381/52 |
| 3,982,070 | 9/1976 | Flanagan | 381/51 |
| 4,163,120 | 7/1979 | Baumwolspiner | 381/51 |
| 4,236,434 | 12/1980 | Nishibe et al. | 381/51 |
| 4,241,235 | 12/1980 | McCanney | 381/61 |
| 4,304,965 | 12/1981 | Blanton et al. | 381/51 |
| 4,398,059 | 8/1983 | Lin et al. | 381/51 |
| 4,435,832 | 3/1984 | Asada et al. | 381/51 |

OTHER PUBLICATIONS

B. S. Atal, Suzanne L. Hanauer—"Speech Analysis and Synthesis by Linear Prediction of the Speech Wave", *The Journal of the Acoustical Society of America,* vol. 50, No. 2 (Part 2), pp. 637-650 (Apr. 1971).

Fant—"Speech Sounds and Features", Published by the MIT Press, Cambridge, Mass., pp. 84-93 (1973).

Flanagan, "Speech Analysis Synthesis Perception", Springer-Verlag, 1972, p. 71.

*Primary Examiner*—E. S. Matt Kemeny

*Attorney, Agent, or Firm*—William E. Hiller; James T. Comfort; Leo Heiting

[57] ABSTRACT

Method and apparatus for converting voice characteristics of synthesized speech from a single applied source of synthesized speech in a manner obtaining modified voice characteristics pertaining to the apparent age and/or sex of the speaker. The apparatus is capable of altering the voice characteristics of synthesized speech to obtain modified voice sounds simulating child-like, teenage, adult, aged and sexual preference characteristics by control of vocal track parameters including pitch period, vocal tract model, and speech data rate. A source of synthesized speech having a predetermined pitch period, a predetermined vocal tract model, and a predetermined speech rate is separated into the respective speech parameters. The values of pitch, the speech data frame length, and the speech data rate are then varied in a preselected manner to modify the voice characteristics of the synthesized speech from the source thereof. Thereafter, the changed speech data parameters are re-combined into a modified synthesized speech data format having different voice characteristics with respect to the synthesized speech from the source, and an audio signal representative of human speech is generated from the modified synthesized speech data format from which audible synthesized speech may be generated.

29 Claims, 13 Drawing Figures

METHOD AND APPARATUS FOR CONVERTING VOICE CHARACTERISTICS OF SYNTHESIZED SPEECH

BACKGROUND OF THE INVENTION

This invention generally relates to a method and apparatus for converting the voice characteristics of synthesized speech to obtain modified synthesized speech from a single source thereof having simulated voice characteristics pertaining to the apparent age and/or sex of the speaker such that audible synthesized speech having different voice sounds with respect to the audible synthesized speech to be generated from the original source thereof may be produced.

In a general sense, speech analysis researchers have understood that it is possible to modify the acoustical characteristics of a speech signal so as to change the apparent sexual quality of the speech signal. To this end, the article "Speech Analysis and Synthesis by Linear Prediction of the Speech Wave"—Atal and Hanauer, *The Journal of the Acoustical Society of America,* Vol. 50, No. 2 (Part 2), pp. 637–650 (April 1971) describes the simulation of a female voice from a speech signal obtained from a male voice, wherein selected acoustical characteristics of the original speech signal were altered, e.g. the pitch, the formant frequencies, and their bandwidths.

In another more detailed approach, the publication "Speech Sounds and Features"—Fant, published by The MIT Press, Cambridge, Mass., pp. 84–93 (1973) sets forth a derived relationship called k factors or "sex factors" between female and male formants, and determined that these k factors are a function of the particular class of vowels. Each of these two early approaches requires a speech synthesis system capable of employing formant speech data and could not accept speech encoding schemes based on some speech synthesis technique other than formant synthesis.

While the conversion of voice characteristics of synthesized speech to produce other voice sounds having simulated voice characteristics pertaining to the apparent age and/or sex of the speaker differing from the voice characteristics of the original synthesized speech offers versatility in speech synthesis systems, heretofore only limited implementation of this general approach has occurred in speech synthesis systems.

A voice modification system relying upon actual human voice sounds as contrasted to synthesized speech and changing the original voice sounds to produce other voice sounds which may be distinctly different from the original voice sounds is disclosed and claimed in U.S. Pat. No. 4,241,235 McCanney issued Dec. 23, 1980. In this voice modification system, the voice signal source is a microphone or a connection to any source of live or recorded voice sounds or voice sound signals. Such a system is limited in its application to usage where direct modification of spoken speech or recorded speech would be acceptable and where the total speech content is of relatively short duration so as to entail significant storage requirements if recorded.

One technique of speech synthesis which has received increasing attention in recent years is linear predictive coding (LPC). In this connection, linear predictive coding offers a good trade-off between the quality and data rate required in the analysis and synthesis of speech, while also providing an acceptable degree of flexibility in the independent control of acoustical parameters. Speech synthesis systems having linear predictive coding speech synthesizers and operable either by the analysis-synthesis method or by the speech synthesis-by-rule method have been developed heretofore. However, these known speech synthesis systems relying upon linear predictive coding as a speech synthesis technique present difficulties in adapting them to perform rescaling or other voice conversion techniques in the absence of formant speech parameters. The conversion from linear predictive coding speech parameters to formant speech parameters to facilitate voice conversion involves solving a nonlinear equation which is very computation intensive.

Text-to-speech systems relying upon speech synthesis have the potential of providing synthesized speech with a virtually unlimited vocabulary as derived from a prestored component sounds library which may consist of allophones or phonemes, for example. Typically, the component sounds library comprises a read-only-memory whose digital speech data representative of the voice components from which words, phrases and sentences may be formed are derived from a male adult voice. A factor in the selection of a male voice for this purpose is that the male adult voice in the usual instance offers a low pitch profile which seems to be best suited to speech analysis software and speech synthesizers currently employed. A text-to-speech system relying upon synthesized speech from a male voice could be rendered more flexible and true-to-life by providing audible synthesized speech with varying voice characteristics depending upon the identity of the characters in the text (i.e., whether male or female, child, teenager, adult or whimsical character, such as a "talking" dog, etc.). Storage limitations in the read-only-memory serving as the voice component sound library render it impractical to provide separate sets of digital speech data corresponding to each of the voice characteristics for the respective "speaking" characters in the text material being converted to speech by speech synthesis techniques.

SUMMARY OF THE INVENTION

In accordance with the present invention, a method and apparatus for converting the voice characteristics of synthesized speech is provided in which any one of a plurality of voice sounds simulating child-like, adult, aged and sexual preference characteristics may be obtained from a single applied source of synthesized speech, such as provided by a voice component sounds library stored in an appropriate memory. The method is based upon separating the pitch period, the vocal tract model and the speech rate as obtained from the source of synthesized speech to treat these speech parameters as independent factors by directing synthesized speech from a single source thereof to a voice character conversion controller circuit which may take the form of a microprocessor. The voice characteristics of the synthesized speech from the source are then modified by varying the magnitudes of the signal sampling rate, the pitch period, and the speech rate or timing in a preselected manner depending upon the desired voice characteristics of the audible synthesized speech to be obtained at the output of the apparatus. In a broad aspect of the method, an acceptable modification of the voice characteristics of the synthesized speech from the source may be achieved by varying the magnitudes of the pitch period and the speech rate only while retaining the original signal sampling rate. In its preferred form, however, the method involves changing the sampling rate as well. In accomplishing this changing of the sampling rate, the pitch period, and the speech rate, control circuits included in the voice character conversion system independently operate upon the respective speech parameters. The modified sampling rate is determined from the character of the voice which is desired and is used with the original pitch period data and the original speech rate data in the development of a modified pitch period and a modified speech rate. Thereafter, the modified pitch period, and the modified speech rate are re-combined in a speech data packing circuit along with the original vocal tract speech parameters to place the modified version of the speech data in a speech data format compatible with the speech synthesizer to which the modified speech data is applied as an input from the speech data packing circuit along with the modified sampling rate. The speech synthesizer is coupled to an audio means which may take the form of a loud speaker such that analog speech signals output from the speech synthesizer are converted into audible synthesized human speech having different voice characteristics from the synthesized human speech which would have been obtained from the original source of synthesized speech.

In a particular aspect in converting the voice characteristics of a source of synthesized speech derived from a male voice to obtain a synthesized speech output having the voice characteristics of a female voice, the separated pitch period, vocal tract model and speech rate from the original source of synthesized speech are generally modified such that the pitch period and the speech rate are decreased in magnitude, while the vocal tract model is scaled in a predetermined manner, thereby producing audible synthesized speech at the output of the voice characteristics conversion system having the apparent quality of a female voice.

In a specific aspect, the original speech data of the source of synthesized speech may exist as formants which are the resonant frequencies of the vocal tract. The changing of voice characteristics of synthesized speech involves the variance of these speech formants either by changing the sampling period or changing the sampling rate which is the reciprocal of the sampling period. Such an operation causes either shifting of the speech formants or peaks in the spectral lines in one direction or the other, or compression or expansion of the speech formants—depending upon how the sampling period or the sampling rate is changed. In a preferred embodiment, the method and apparatus for converting voice characteristics of synthesized speech controls the formant structure of the speech data by including additional time periods within each sample period as compared to the existing number of time periods in the original synthesized speech obtained from the source. These added time periods within each sample period are idle states such that each sample period is controlled by increasing the number of idle states exemplified by time increments therewithin from zero to a variable number, thereby changing the total time interval of the sample period which has the effect of rescaling the speech formants in converting the voice characteristics of the synthesized speech as obtained from the original source thereof. This altering of the speech formants is accompanied by adjustments in the pitch period and speech rate period, while the original vocal tract parameters are retained in the re-combined modified speech parameters by the speech data packing circuitry for providing the proper speech data format to be accepted by the speech synthesizer.

In an alternative embodiment, the sample period can be controlled digitally by controlling the length of each clock cycle in the sample period (thereby changing the sampling rate) through the variance of a base oscillator rate. This embodiment requires a variable oscillator, e.g. a digitally controlled oscillator to be controlled digitally by the microprocessor controller for providing a selected oscillator rate.

In the implementation of a text-to-speech system employing speech synthesis, the method and apparatus for converting voice characteristics of synthesized speech in accordance with the present invention adapt the voice sound components library stored in the speech ROM of the text-to-speech system in a manner enabling the output of audible synthesized speech having a plurality of different voice characteristics of virtually unlimited vocabulary.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings wherein:

DETAILED DESCRIPTION OF THE INVENTION

Figure 1:
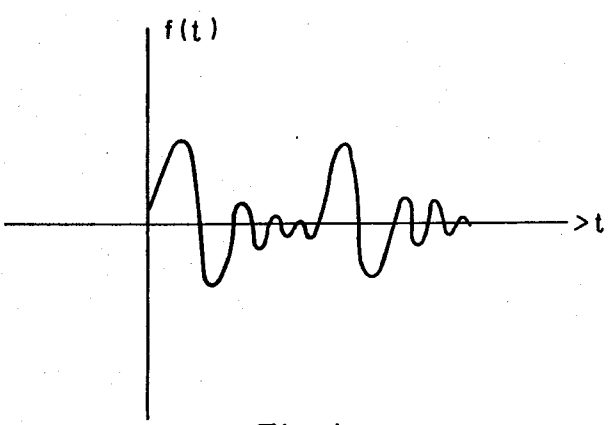
FIG. 1 is a graphical representation of a segment of a voiced speech waveform with respect to time.
Figure 2:
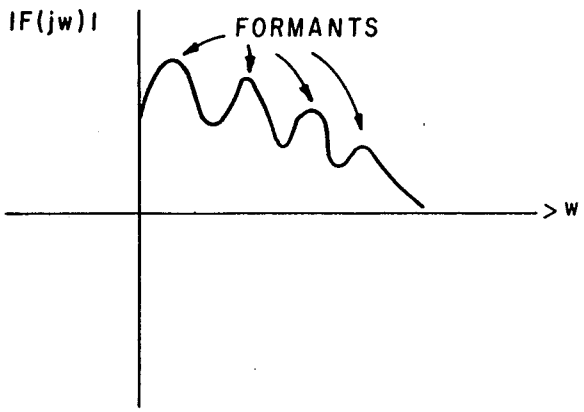
FIG. 2 is a graphical representation showing the short time Fourier transform of the voiced speech waveform of FIG. 1.
Figure 3:
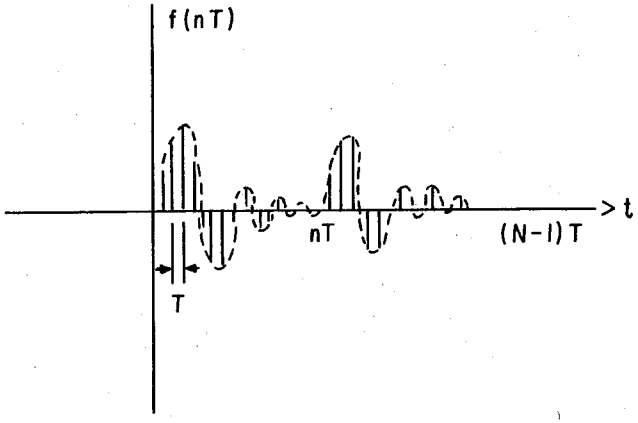
FIG. 3 is a graphical representation of the digitized speech waveform corresponding to FIG. 1.

Referring more specifically to the drawings, the method and apparatus disclosed herein are effective for converting the voice characteristics of synthesized speech from a single applied source thereof in a manner obtaining modified voice characteristics pertaining to the apparent age and/or sex of the speaker, wherein audible synthesized speech having different voice sounds covering a wide gamut of voice characteristics simulating child-like, adult, age and sexual characteristics may be obtained as distinct voice sounds from a single applied source of synthesized speech. In a more specific aspect of the invention, the method herein disclosed provides a means of converting the voice characteristics of a source of synthesized speech having as its origin a normal male adult voice to a modified audible synthesized voice output having female voice characteristics. It is contemplated that the voice characteristics conversion method and apparatus will operate on three sets of speech parameters of the source of synthesized speech, namely—the sampling rate S, the pitch period P, and the timing or duration R. The effect of the sampling rate on synthesized speech characteristics is observable by referring to FIGS. 1–4. In this respect, FIGS. 1–2 respectively illustrate a segment of a voiced synthesized speech waveform and its short time Fourier transform. The Fourier transform as illustrated in FIG. 2 exhibits peaks in the envelope thereof. These peaks are so-called speech formants, which are the resonant frequencies of the vocal tract. Formant speech synthesis reproduces audible speech by recreating the spectral shape using the formant center frequencies, their bandwidths, and the pitch period as inputs. A typical practical application of processing synthesized speech normally employs a digital computer or a special purpose digital signal processor, thereby requiring the voiced speech waveform of FIG. 1 to be first converted into a digital format, such as by employing a suitable analog-to-digital converter. FIG. 3 illustrates a digitized voiced speech waveform corresponding to the analog voiced speech waveform of FIG. 1, where T is the sampling period and 1/T is the sampling rate. From FIG. 3, the following relationship is developed:

$$f(nT)=f(t) \text{ at } t=nT, \text{ where N=total number of samples.}$$

Figure 4:
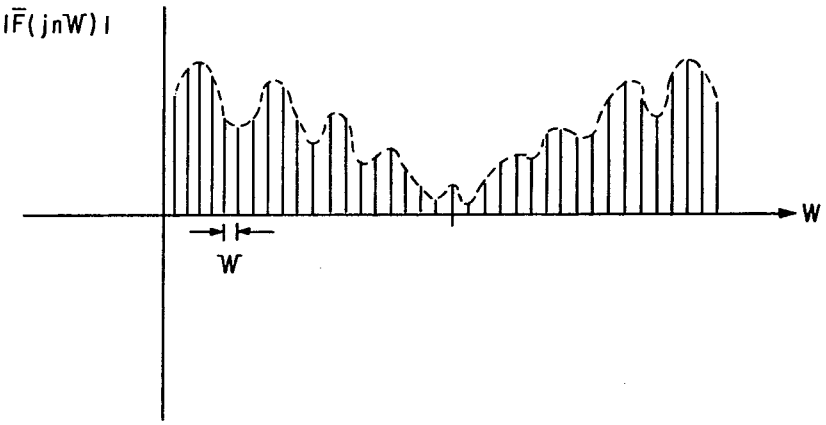
FIG. 4 is a graphical representation of the discrete Fourier transform of the digitized speech waveform of FIG. 3.

The discrete Fourier transform (DFT) of the digitized speech waveform shown in FIG. 3 is illustrated in FIG. 4. It will be observed that the envelopes of the respective Fourier transforms shown in FIGS. 2 and 4 exhibit substantial similarity. However, the DFT of FIG. 4 exhibits distinctive features as compared to its counterpart shown in FIG. 2 which is the Fourier transform of a continuous signal. The DFT of FIG. 4 initially presents a repetitive envelope having a somewhat attenuated amplitude, but is not a continuous curve, comprising instead a sequence of discrete spectral lines as examplified by the following relationship:

$$|\overline{F}(jnW)| = |\overline{F}(jw)| \text{ at } w=nW, \text{ where } W=2\pi/NT$$

In the above relationship, the DFT is a sequence of spectral lines sampled at w=nW, where W=the distance between two spectral lines.

In FIG. 4, the distance between each two consecutive spectral lines of the DFT illustrated therein is proportional to 1/T, i.e. the sampling rate. This can be shown using the following mathematical analysis:

$$\overline{F}(jw) = (1/T)^* \sum_{n=-\infty}^{\infty} F(jw - j2n\,\pi/T)$$

Letting w=mW, then $$\overline{F}(jmW) = (1/T)^* \sum_{n=-\infty}^{\infty} F(jmW - j2n\,\pi/T),$$

$$m = 0, 1, 2, \ldots, N-1.$$

The above equations demonstrate that the DFT is a superposition of an infinite number of shifted Fourier transforms. Moreover, the repetition period on the w axis is $2\pi/T$ with N uniform spectral lines, and the distance between these spectral lines is $(2\pi/T)/N=2\pi/NT$, or proportional to 1/T, the sampling rate. Thus, when the sampling period T is reduced or the sampling rate 1/T is increased, the spectral lines in the DFT of FIG. 4 will be shifted toward the right. Consequently, the formants or peaks in the spectral lines will also be shifted toward the right. Conversely, an increase in the sampling period will have the effect of shifting the formants to the left. In accordance with the present invention, therefore, the formants in the speech waveform are rescaled in achieving voice characteristics conversion of synthesized speech from a single applied source thereof by controlling the sampling period. Control of the sampling period is accomplished either by effectively increasing the length of the sample period T or by digitally controlling the sample period through regulation of the number of clock cycles per sample period.

Figure 5:
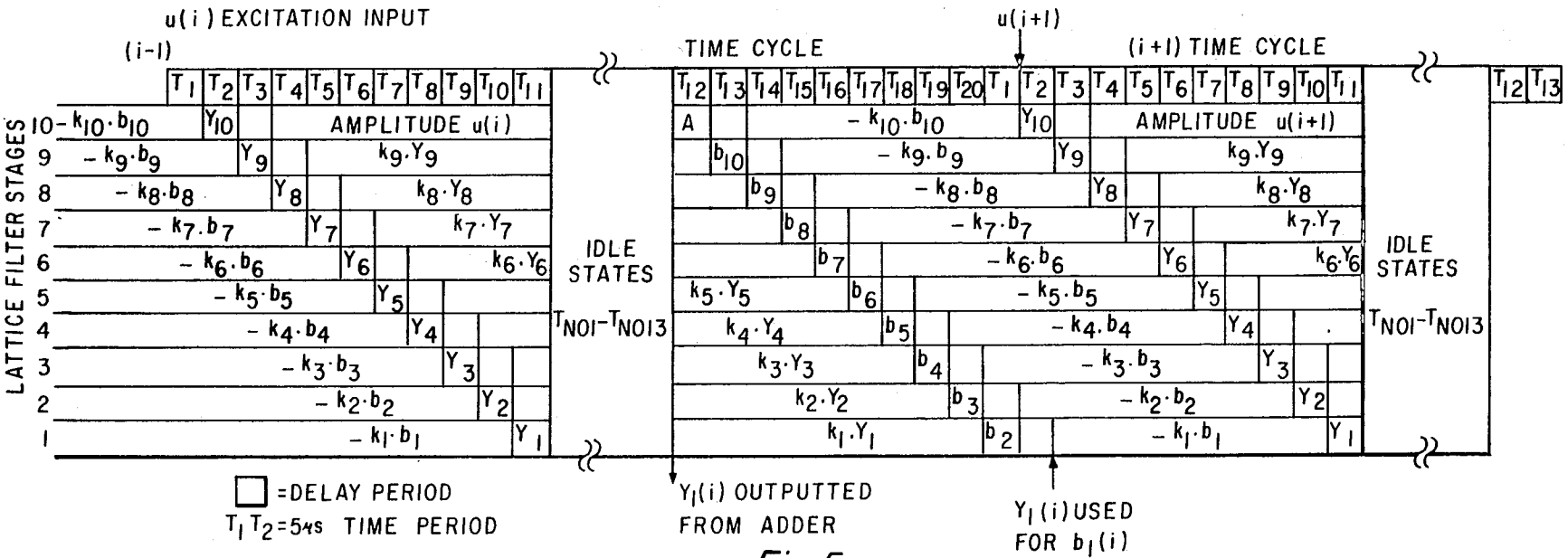
FIG. 5 is a diagrammatic showing illustrating a preferred technique for changing the speech sampling period in achieving conversion of voice characteristics of synthesized speech in accordance with the present invention.

In the preferred embodiment in accordance with the present invention, it is proposed to control the sample period digitally by introducing additional time increments within the overall sample period. This technique is generally illustrated in FIG. 5. In this connection, one should understand how a speech synthesizer generates speech signals as an output to be converted by audio means, such as a loud speaker, into audible synthesized human speech from the speech parameters received at the input of the speech synthesizer. In the linear predictive coding speech synthesizer disclosed in U.S. Pat. No. 4,209,836 Wiggins, Jr. et al issued June 24, 1980, for example, which patent is incorporated herein by reference, each sample period is broken into twenty equal periods, called T-times, i.e. T1–T20. The digital filter described in the aforesaid U.S. patent operates on a 100 microsecond sample period broken into twenty equal periods, or T-times T1–T20. During each sample period of 100 microseconds, twenty multiplies and twenty additions occur in a pipeline fashion as synchronized by the T-times. During each T-time, a different task is accomplished. It is contemplated herein in accordance with a preferred technique for achieving voice characteristics conversion to control the sample period T by introducing additional T-times to the already existing T1–T20 time increments. As illustrated in FIG. 5, the added T-times are idle states $T_{NO}1$–$T_{NO}13$, for example. It will be understood that the number of added T-times to the original T-times of the sample period T is arbitrary and could be greater or less than the 13 idle states shown in FIG. 5. In like manner, the original T-times defining the sample period T could be greater or less than 20. By varying the number of idle states $T_{NO}1$–$T_{NO}$, the duration of the sample period T can be varied, as for example from 90 microseconds to 150 microseconds. From the data listed in Table I, we have determined that by varying the number of idle states from zero to thirteen, the sample period T can be varied from 90 microseconds to 149 microseconds. Using 90 microseconds as the base sample period T (with zero idle states $T_{NO}$ added), we have determined that a normal male adult voice can be generated from a synthesized speech source obtained from a child by adding eight idle states $T_{NO}1$–$T_{NO}8$, whereas a normal female adult voice can be generated by adding only one idle state $T_{NO}1$.

TABLE I

| ADDED T-TIMES $T_{NO}$ | TOTAL T-TIMES PER SAMPLE | SAMPLE PERIOD T | PERCENTAGE SHIFT OF SPEECH FORMANTS | TYPE OF VOICE |
|---|---|---|---|---|
| 0 | 20 | 90 uS | 0% | Child |
| 1 | 21 | 95 uS | 5% | Female |
| 2 | 22 | 99 uS | 10% | |
| 3 | 23 | 104 uS | 15% | |
| 4 | 24 | 108 uS | 20% | |
| 5 | 25 | 112 uS | 25% | |
| 6 | 26 | 117 uS | 30% | |
| 7 | 27 | 121 uS | 35% | |
| 8 | 28 | 126 uS | 40% | Male |
| . | . | . | . | . |
| . | . | . | . | . |
| . | . | . | . | . |
| 13 | 33 | 149 uS | 65% | Old Man |

This technique of rescaling speech formants by increasing or decreasing the sample period T offers advantages in that it is a relatively simple technique for manipulating speech formants in a speech synthesis system employing linear predictive coding, and the identity of phonemes or allophones comprisng the speech vocabulary source as obtained from a read-only-memory is retained after the speech formants have been rescaled. It will be understood, however, that the pitch period and the speech rate or duration must be adjusted in accommodating the rescaled speech formants to compensate for the effect thereon caused by the speech formant rescaling technique as described herein.

An alternate technique for controlling the sampling period in a linear predictive coding speech synthesis system for the purpose of voice characteristics conversion is illustrated in FIG. *6a*. This alternate technique involves controlling the clock frequency of an LPC speech synthesizer 10 as coupled to audio means in the form of a loud speaker 11 via a variable oscillator 12. The oscillator 12 may take the form of a digitally controlled oscillator DCO such as illustrated in FIG. *6b*, for example. In this connection, the frequency of oscillation generated by the DCO 12 is controlled by a digital input thereto as regulated by a controller 13 which may be in the form of a microprocessor. A single applied source of synthesized speech 15, such as a speech read-only-memory, is accessed by the microprocessor controller 13 to provide selected speech data to the LPC synthesizer 10 while also digitally controlling the DCO 12, thereby controlling the clock frequency of the synthesizer 10. As an example, the LPC speech synthesizer 10 may be a TMS5220 synthesizer chip available from Texas Instruments Incorporated of Dallas, Tex. whose clock frequency is accurately controlled over a frequency range of 250–500 KHz, with a frequency tolerance variation of +1% (+2.5 KHz) of an oscillator DCO 12 of suitable type, such as illustrated in FIG. *6b*.

The digitally controlled oscillator DCO 12 of FIG. *6b* employs a digitally controlled astable multivibrator. A digital signal $\bar{x}_0, \bar{x}_1, \ldots \bar{x}_{n-1}$ from the microprocessor controller 13 switches the transistors $Q_1, Q_2, \ldots Q_{n-1}$, $Q_{101}, Q_{102} \ldots Q_{10n}$ respectively. This switching action in turn controls the frequency output of the multivibrator by controlling the RC time constants (i.e., $R_0C$) where the output frequency is defined as $$f = \frac{1}{1.38\,RC},$$

with R being the parallel combination of $R_0 \ldots R_{N-1}$.

If the speech synthesizer 10 uses a resistive-controlled oscillator, the digitally controlled oscillator DCO 12 may be modified to provide an input to the synthesizer oscillator comprising the parallel combinations of the respective resistor lines $R_o \ldots R_{N-1}$ from the collectors of corresponding transistors. By way of background information on this aspect, attention is directed to "Pulse, Digital and Switching Waveforms" Millman et al, published by McGraw-Hill Book Co., N.Y., N.Y., pp. 438ff (1965).

It will be understood that the variable oscillator 12 of FIG. *6a* could be a suitable voltage-controlled oscillator VCO (not shown), in which case a digital-to-analog converter of an appropriate type would be interconnected between the output of the microprocessor controller 13 and the input of the VCO to provide an analog voltage input thereto effectively regulated digitally by the microprocessor controller 13.

In either of the techniques illustrated in FIGS. 5 and *6a*, as indicated hereinbefore, the pitch period P and the speech rate or duration R must be adjusted to accommodate the rescaled speech formants. Pitch is a distinctive speech parameter having a significant bearing on the voice characteristics of a given source of synthesized speech and can be used to identify the voice sound of a normal adult male from that of a normal adult female. In this instance, typically a normal adult male voice has a fundamental frequency within the range of 50 Hz to 200 Hz, whereas a normal adult female voice could have a fundamental frequency up to 400 Hz. Therefore, some degree of pitch period scaling is required in the method of converting voice characteristics in accordance with the present invention. In a typical speech synthesis system during the prosody assignment or syllable-accenting assignment of a certain phrase, the pitch profile of a certain phrase is controlled by a base pitch period BP. For normal adult male speech, the base pitch period is usually assigned in the range of 166–182 Hz, and for normal adult female speech, the base pitch period is generally chosen to be between 250–267 Hz. In the speech synthesizer chip TMS5220 available from Texas Instruments Incorporated of Dallas, Tex., these pitch levels would be coded pitch levels 44–48 and 30–32 respectively.

Timing (i.e., duration) or speech rate R is also determinative of the character of voice sounds. Timing control or duration control can be applied to a speech phrase, a word, a phoneme, or an allophone, or a speech data frame. Four timing controls or four speech rates are available in the speech synthesizer chip TMS5220: 20 milliseconds/frame, 15 milliseconds/frame, 10 milliseconds/frame, and 5 milliseconds/frame. While the speech synthesizer TMS5220 is in the variable frame rate mode, the speech synthesizer is conditioned to expect the input of two duration bits in a speech frame indicating the rate of that frame. Thus, in the speech synthesizer chip TMS5220, for example, the four speech rates R are:

| SPEECH RATE | DURATION BITS | MILLISECONDS/ FRAME |
|---|---|---|
| 1 | 0 0 | 5 |
| 2 | 0 1 | 10 |
| 3 | 1 0 | 15 |
| 4 | 1 1 | 20 |

Timing control or duration control R is important to compensate for any difference in speech rate which may be caused by sampling rate adjustments in the manner previously described, and to accent the speech rate characteristics in achieving a particular voice sound characteristic.

In a broad aspect of the method for converting voice characteristics of synthesized speech, the original sampling period associated with the source of synthesized speech may be maintained, while the pitch period and speech rate are adjustably controlled to achieve different voices from the single source of synthesized speech.

Figure 6A:
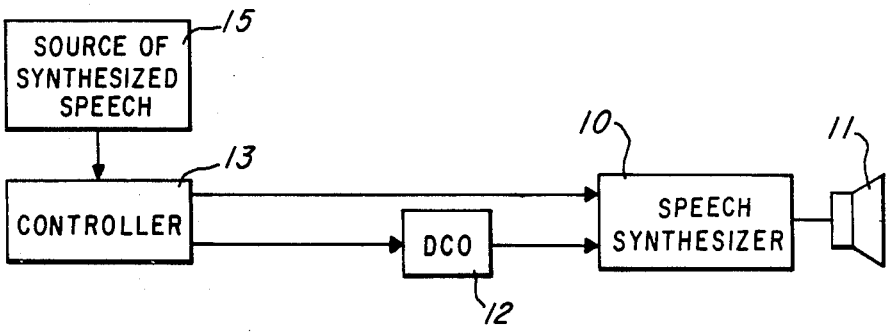
FIG. 6*a* is a block diagram showing a control circuit for controlling the clock frequency of a speech synthesizer to change the sampling rate in another embodiment of converting voice characteristics of synthesized speech in accordance with the present invention.
Figure 6B:
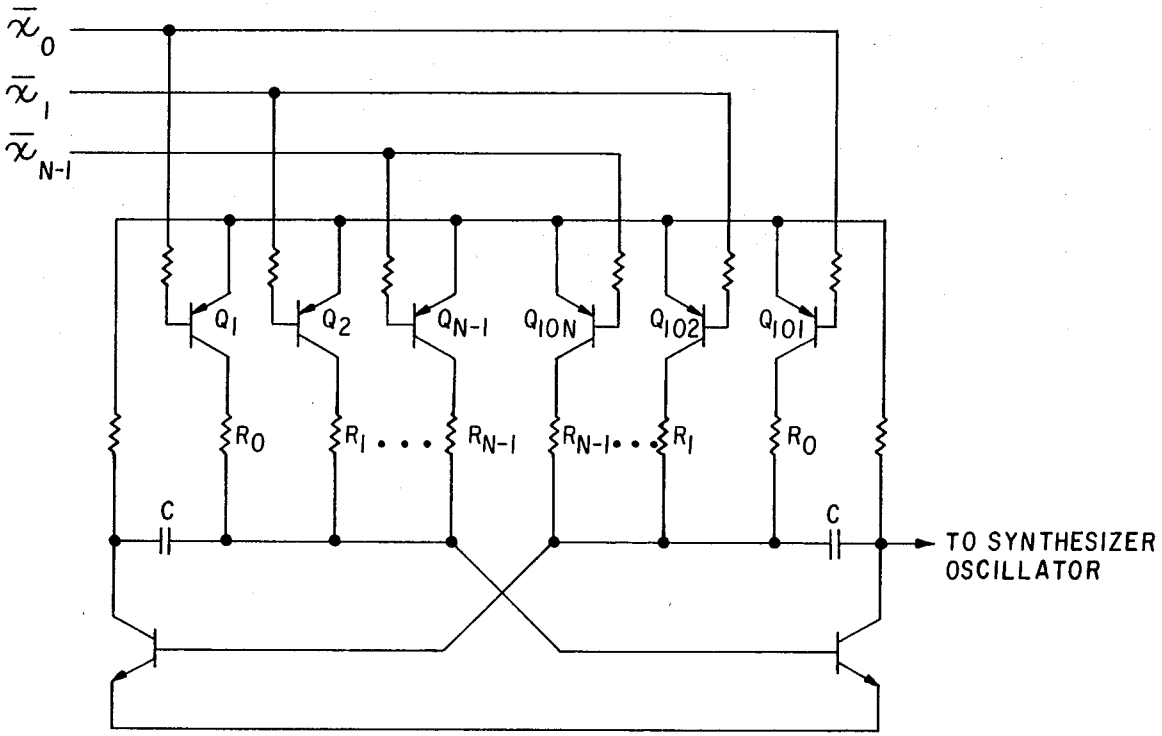
FIG. 6*b* is a circuit diagram of a digitally controlled oscillator suitable for use in the control circuit of FIG. 6*a;*
Figure 7A:
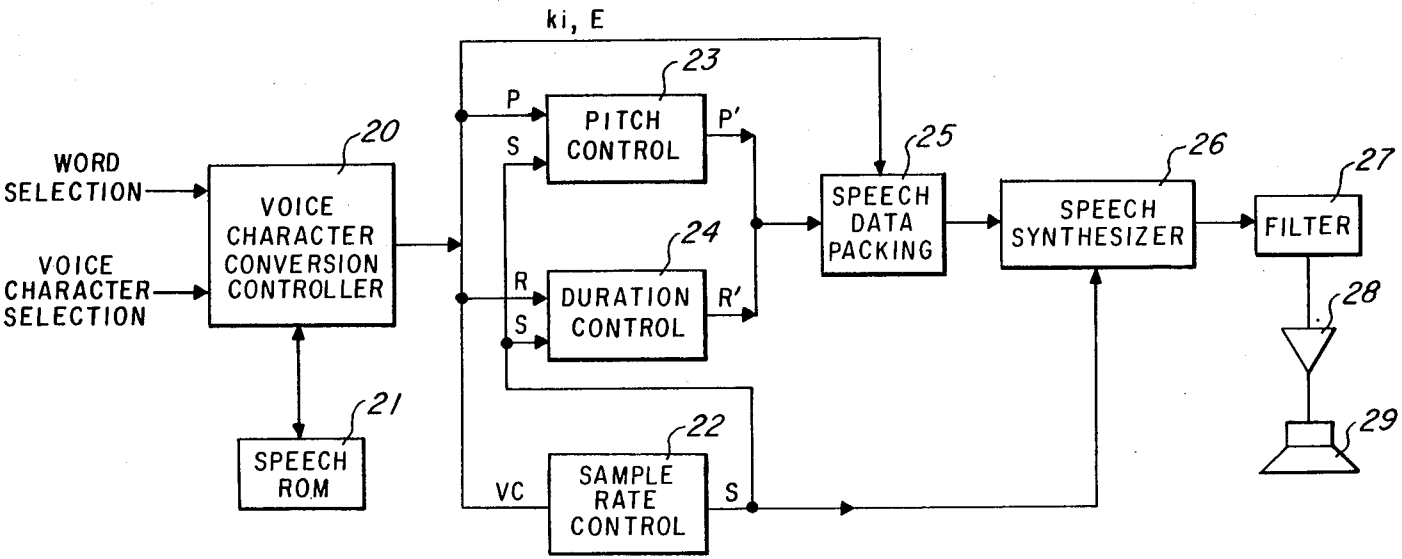
FIG. 7*a* is a functional block diagram of a voice characteristics conversion apparatus in accordance with the present invention.
Figure 7B:
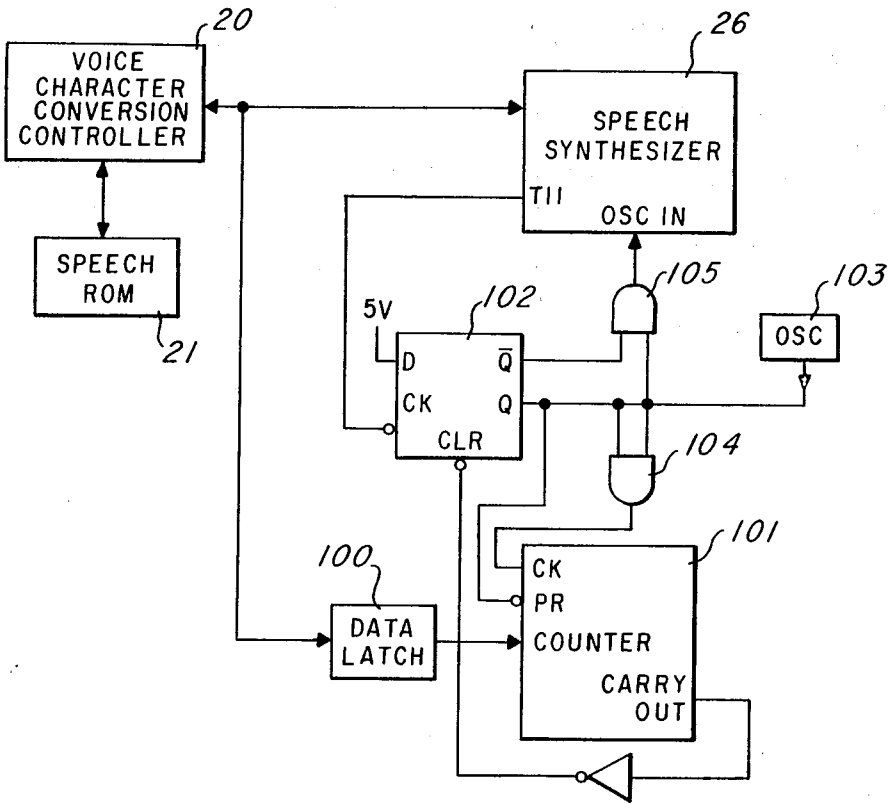
FIG. 7*b* is a circuit schematic of the voice characteristics conversion apparatus shown in FIG. 7*a;*

FIG. *7a* illustrates in block diagram form a voice characteristics conversion apparatus for synthesized speech as constructed in accordance with the present invention, wherein sample rate control, pitch period control, and speech duration or speech rate control are regulated as independent factors in the manner previously described. Referring to FIG. *7a*, the voice characteristics conversion apparatus comprises a voice character conversion controller 20 which may be in the form of a microprocessor, such as the TMS7020 manufactured by Texas Instruments Incorporated of Dallas, Tex. which selectively accesses digital speech data and digital instructional data from a memory 21, such as a read-only-memory available as component TMS6100 from Texas Instruments Incorporated of Dallas, Tex. It will be understood that the digital speech data contained within the speech ROM 21 may be representative of allophones, phonemes or complete words. Where the digital speech data in the speech ROM 21 is representative of allophones or phonemes, various voice components may be strung together in different sequences or series in generating digital speech data forming words in a virtually unlimited vocabulary. The voice character conversion controller 20 is programmed as to word selection and as to voice character selection for respective words such that digital speech data as accessed from the speech ROM 21 by the controller 20 is output therefrom as preselected words (which may comprise stringing of allophones or phonemes) to which a predetermined voice characteristics profile is attributed. The digital speech data for the selected word as output from the controller 20 is separated into a plurality of individual speech parameters, namely—pitch period P, energy E, duration or speech rate R, and vocal tract parameters $k_i$. The voice character information VC incorporated in the output from the controller 20 is separately provided as an input to a sample rate control means 22 for generating the sample rate S as determined by the voice character information VC by either digital or analog control of the sample rate as described in conjunction with FIGS. 5 and 6a respectively. The pitch period information P from the output of the controller 20 is provided as an input to the pitch control circuit 23 along with the sample rate S as output from the sample rate control circuit 22 to develop the modified pitch period signal P′ as an output from the pitch control circuit 23. In like manner, the speech rate information or duration information R from the output of the controller 20 is provided as an input to the duration control circuit 24 along with the sample rate S from the output of the sample rate control circuit 22 in determining a new speech rate or duration signal R′ as an output from the duration control circuit 24 to compensate for the change in the sample rate as determined by the voice character information VC input to the sample rate control circuit 22. The voice characteristics conversion apparatus further includes a speech data packing circuit 25 for combining the modified speech parameters into a speech data format compatible with a speech synthesizer 26 to which the output of the speech data packing circuit 25 is connected. To this end, the modified pitch period signal P′ as output from the pitch control circuit 23, and the modified speech rate or duration signal R′ as output from the duration control circuit 24 are provided as inputs to the speech data packing circuit 25 along with the original vocal tract parameters $k_i$ and energy E. The newly combined speech parameters as output in a speech data format by the speech data packing circuit 25 are input to the speech synthesizer 26 simultaneously with the predetermined new sample rate S as determined by the voice character information VC input to the sample rate control circuit 22. The speech synthesizer 26 accepts the modified speech parameter signals in generating analog audio signals representative of synthesized human speech having voice characteristics different from the source of synthesized speech stored in the speech ROM 21. Appropriate audio means, such as a suitable bandpass filter 27, a preamplifier 28 and a loud speaker 29 are connected to the output of the speech synthesizer 26 to provide audible synthesized human speech having different voice characteristics from the source of synthesized speech as stored in the speech ROM 21.

FIG. *7b* is a schematic circuit diagram further illustrating the voice character conversion apparatus of FIG. *7a* and showing one implementation of achieving sample rate control wherein the sample rate may be modified in a predetermined manner by adding idle states to the sample period in accordance with FIG. 5. Thus, the sample rate control circuit comprises a data latch device 100 connected to the output of the voice character conversion controller 20 for receiving a preset value in a given instant from the controller 20 (as determined by the desired voice character). The preset value in the data latch 100 is communicated as a preset count to an incrementing counter 101 which may be a 4-bit counter, for example, thereby permitting sixteen different frame rates. The counter 101 has terminals CARRY OUT, CK, and PR. The CARRY OUT terminal is operable when the counter 101 is incremented to its maximum count. The critical unit of time as determined by the counter 101 is the additional time between the preset count therein as established by the data latch 100 and the maximum count, this additional time corresponding to the number of idle states added to the sample period. A D-latch device 102 has terminals CLR, CK, D, Q and $\overline{Q}$. A reference potential is provided to the D terminal. The CLR ("clear") terminal of the D-latch device 102 is connected to the inverted output of the CARRY OUT terminal of the counter 101 and receives a CLR signal thereof when the counter 101 reaches its maximum count. The CLR signal causes the Q terminal of the D-latch 102 to have an output at logic "0", and the $\overline{Q}$ terminal to have an output at logic "1" which causes the counter 101 to be preset, the counter clock to be disabled, and the clock to the speech synthesizer 26 to be enabled. This state continues for 20 T-times until a new T11 signal is generated. When time increment T11 of the sample period occurs, Q goes to "1", and gates the oscillator clock. During the period of time that the D-latch 102 is cleared (the time other than that between the pre-set count and the maximum count), the Q terminal is at logic "0" and the $\overline{Q}$ terminal is at logic "1". The sample rate control circuit further includes an oscillator 103 and AND gates 104, 105. The output of the oscillator provides one input to each of the AND gates 104, 105, the Q terminal providing the other input to AND gate 104 and the $\overline{Q}$ terminal providing the other input to AND gate 105. Thus, the oscillator clock 103 drives either the speech synthesizer 26 or the counter 101, but not both simultaneously. in effect, therefore, the speech synthesizer 26 is only enabled during the time that the $\overline{Q}$ terminal of D-latch 102 is at logic "1" and is idle during the time that the $\overline{Q}$ terminal is at logic "0" which corresponds to the time period between the preset count and the maximum count of the counter 101.

The modified pitch period information P′ and the modified speech rate information or duration information R′ are based upon the desired voice character in conjunction with the change in the sample rate and are derived in accordance with the general guidelines indicated by the data provided in Table II which appears hereinafter. In the latter connection, it will be understood that the voice character conversion controller 20 is appropriately programmed to effect the required adjustments in the pitch parameter and the speech rate information as provided by logic circuitry within the speech synthesizer 26.

Figure 8:
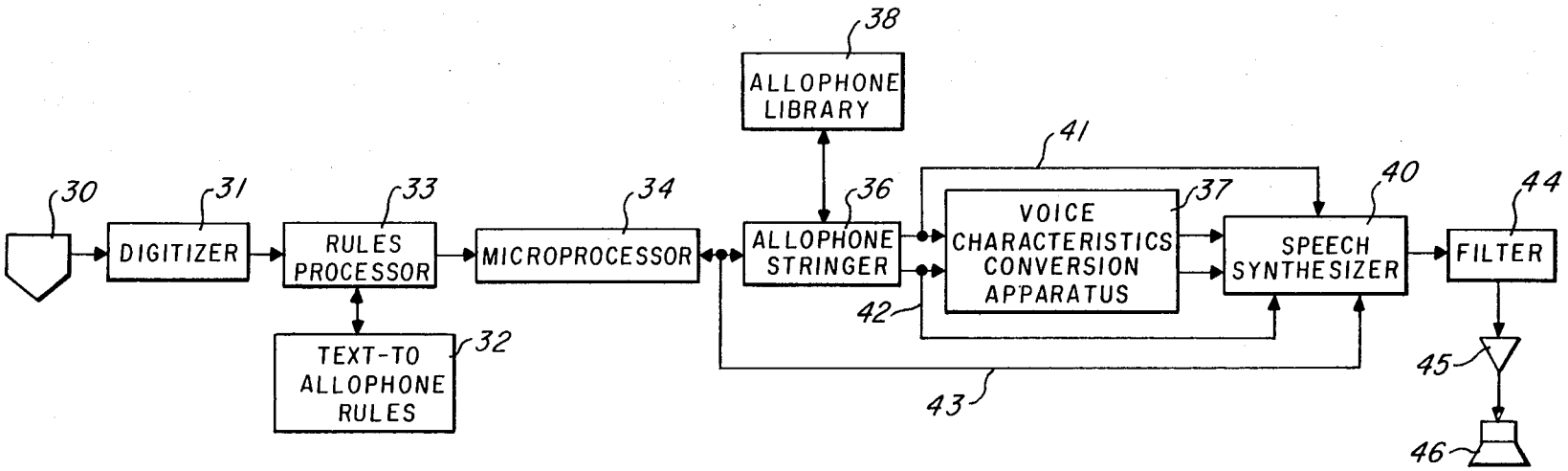
FIG. 8 is a block diagram of a text-to-speech system utilizing the voice characteristics conversion apparatus of FIG. 7*a;*

A text-to-speech synthesis system is illustrated in FIG. 8 in which the voice characteristics conversion apparatus of FIG. *7a* is incorporated. The test-to-speech synthesis system corresponds to that disclosed in pending U.S. application, Ser. No. 240,694 filed Mar. 5, 1981, which is hereby incorporated by reference. The text-to-speech synthesis system includes a suitable text reader 30, such as an optical bar code reader for example, which scans or "stares" at text material, such as the page of a book for example. The output of the text reader 30 is connected to a digitizer circuit 31 which converts the signal representative of the textural material scanned or read by the test reader 30 into digital character code. The digital character code generated by the digitizer circuit 31 may be in the form of ASCII code and is serially entered into the system. In the latter connection, the ASCII code may also be entered from a local or remote terminal, a keyboard, a computer, etc. A set of text-to-allophone rules is contained in a read-only-memory 32 and each incoming character set of digital code from the digitizer 31 is matched with the proper character set in the text-to-allophone rules stored in the memory 32 by a rules processor 33 which comprises a microcontroller dedicated to the comparison procedure and generating allophonic code when a match is made. The allophonic code is provided to a synthesized speech producing system which has a system controller in the form of a microprocessor 34 for controlling the retrieval from a read-only-memory or speech ROM 35 of digital signals representative of the individual allophone parameters. The speech ROM 35 comprises an allophone library of voice component sounds as represented by digital signals whose addresses are directly related to the allophonic code generated by the microcontroller or rules processor 33. A dedicated microcontroller or allophone stringer 36 is connected to the speech ROM or allophone library 35 and the system microcontroller or microprocessor 34, the allophone stringer 36 concatenating the digital signals representative of the allophone parameters, including code indicating stress and intonation patterns for the allophones. In effect, therefore, the speech ROM or allophone library 35 and the microcontroller or allophone stringer 36 correspond to the speech ROM 21 of the voice characteristics conversion apparatus illustrated in FIG. *7a* and are connected via the allophone stringer 36 to the voice character conversion controller of the voice characteristics conversion apparatus 37, as shown in FIG. 8. In addition, the speech ROM or allophone library 35 and the microcontroller or allophone stringer 36 are connected to the speech synthesizer 40 via the allophone stringer 36 through conductors 41, 42 by-passing the voice characteristics conversion apparatus 37, as is the system microprocessor 34 via the by-pass conductor 43. It will be understood that the particular voice characteristics associated with the digital speech data stored in the speech ROM or allophone library 35 may be routed to the speech synthesizer 40 without changing the voice characteristics of the audible synthesized speech to be produced at the output of the system by the audio means comprising the serially connected band-pass filter 44, the amplifier 45 and the loud speaker 46. In the latter respect, instructions within the system microprocessor 34 may direct the concatenated digital signals produced by the allophone stringer 36 via the conductors 41, 42 to the speech synthesizer 40 without involving the voice characteristics conversion apparatus 37. In a preferred form, the speech synthesizer 40 is of the linear predictive coding type for receiving digital signals either from the allophone stringer 36 or the voice characteristics conversion apparatus 37 when it is desired to change the voice characteristics of the allophonic sounds represented by the digital speech data contained in the speech ROM or allophone library 35. In the latter connection, the voice characteristics conversion apparatus 37 functions in the manner described with respect to FIG. *7a* in modifying the voice characteristics of the applied signal source of synthesized speech derived from the speech ROM or allophone library 35 in producing audible synthesized speech at the output of the system having voice characteristics different from those associated with the original digital speech data stored in the speech ROM or allophone library 35. Thus, the method for converting the voice characteristics of synthesized speech in accordance with the present invention is applicable to any type of speech synthesis system relying upon linear predictive coding and is readily implemented on a speech synthesis-by-rule system during the process of stressing or prosody assignment. In the text-to-speech system illustrated in FIG. 8, a plurality of different voices are available from the digital speech data stored in the speech ROM or allophone library 35 by controlling the base pitch BP in stressing, four such voices being available in one instance, as follows:

(1) high-tone voice: BP=26 and speech rate=3;

(2) mid-tone voice: BP=46 and speech rate=variable duration control;

(3) low-tone voice: BP=56 and speech rate=3 or 4; and (4) whispering voice: BP=0 and speech rate=3 or 4.

In the above examples, the pitch periods are taken from the codec of the speech synthesizer chip TMS5220A available from Texas Instruments Incorporated of Dallas, Tex.

Further voice characters can be created by changing the sampling period while controlling the base pitch and the speech rate. In this instance, Table II lists the voice characteristics employed to obtain distinct voices from a single source of synthesized speech existing as digital speech data in a speech ROM.

TABLE II

| VOICE CHARACTER | SAMPLING PERIOD | SPEECH RATE | BP | DP |
|---|---|---|---|---|
| Mickey Mouse | 90 usec | 2 or 3 | 44–48 | 4–6 |
| Child's | 90 usec | 3 or 4 | 26 | 4–6 |
| Female's | 90–95 usec | 3 or 4 | 30–32 | 4–6 |
| Old man's | 150 usec | 3 | 56–63 | 4–6 |
| Normal adult male | 125 usec | 3 or 4 | 44–48 | 4–6 |

For each voice, modification of the delta pitch (DP) can cause the voice to be inflected or of a monotone nature.

Figure 9:
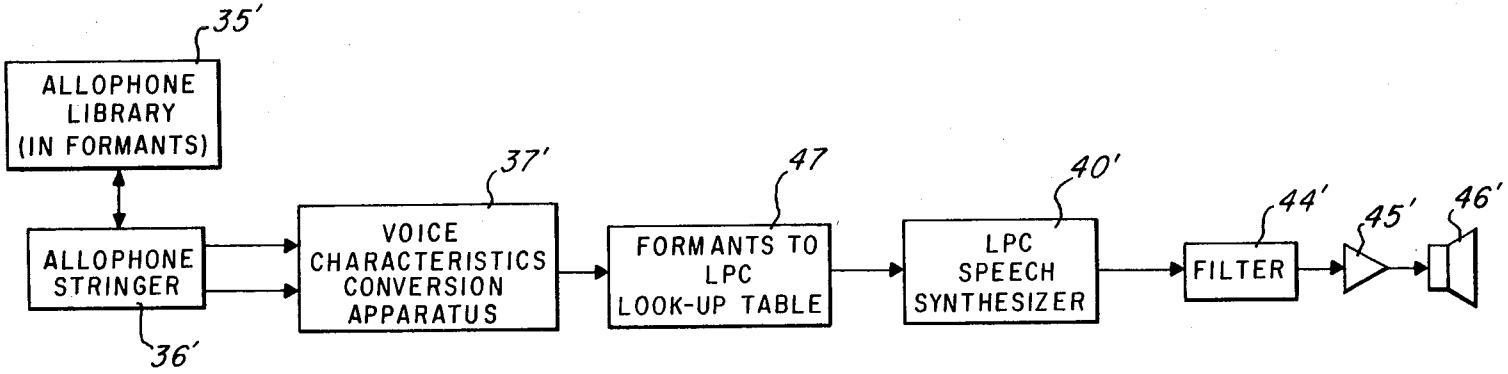
FIG. 9 is a block diagram of a preferred embodiment of a speech synthesis system utilizing speech formants as a speech data source and a voice characteristics conversion apparatus in accordance with the present invention.

FIG. 9 illustrates a preferred embodiment of a speech synthesis system having a voice characteristics conversion apparatus incorporated therein for producing a plurality of distinct voices at the output of the system as audible synthesized human speech from a single applied source of digital speech data from which synthesized speech may be derived. In this respect, FIG. 9 shows a general purpose speech synthesis system which may be part of a text-to-synthesized speech system as shown in FIG. 8, or alternatively may comprise the complete speech synthesis system without the aspect of converting text material to digital codes from which synthesized speech is to be derived. To this end, components in the speech synthesis system of FIG. 9 common to those components illustrated in FIG. 8 have been identified by the same reference numeral with a prime notation added. The speech ROM or allophone library 35' of the speech synthesis system illustrated in FIG. 9 contains digital speech data in formants representative of allophone parameters from which the audible synthesized speech is to be derived via an LPC speech synthesizer 40'. The allophone parameters in formants from the speech ROM or allophone library 35' are concatenated by a dedicated microcontroller or allophone stringer 36', the allophone formants being directed in serially arranged words via the allophone stringer 36' to the voice characteristics conversion apparatus 37' which operates thereon in the manner described in connection with FIG. *7a*. The speech synthesis system of FIG. 9 adds a look-up table 47 for converting speech formants as output from the speech data packing circuit of the voice characteristics conversion apparatus 37' to digital speech data representative of reflection coefficients to render the speech data compatible with the LPC speech synthesizer 40' connected to the output of the look-up table 47 for converting speech formants to digital speech data compatible with linear predictive coding. In this respect, a look-up table of the character described in disclosed in U.S. Pat. No. 4,304,965 Blanton et al issued Dec. 8, 1981, which patent is incorporated herein by reference. The use of speech formant parameters in the present method and apparatus for converting voice characteristics of synthesized speech facilitates rescaling of the formant parameters in the manner described with respect to FIGS. 1–6. In the preferred embodiment of the present invention, voice characteristics conversion is accomplished on digital speech data representative of speech formant parameters, such as shown in FIG. 4 by the spectral lines. Thereafter, the speech formant parameter format of the digital speech data is converted to digital speech data representative of reflection coefficients and therefore compatible with a speech synthesizer utilizing LPC as the speech synthesis technique. It will be understood, therefore, that a plurality of different voice sounds simulating child-like, adult, aged and sex characteristics may be derived from a single applied source of synthesized speech, such as the speech ROM or allophone library 35' of FIG. 9, where the digital speech data stored therein is representative of speech formant parameters. Such a speech ROM or allophone library 35' also provides a virtually unlimited vocabulary operating in conjunction with the allophone stringer 36' to provide the speech synthesis system of FIG. 9 with a versatility making it especially suitable for use in a text-to-speech synthesis system, as is shown in FIG. 8.

Figure 10:
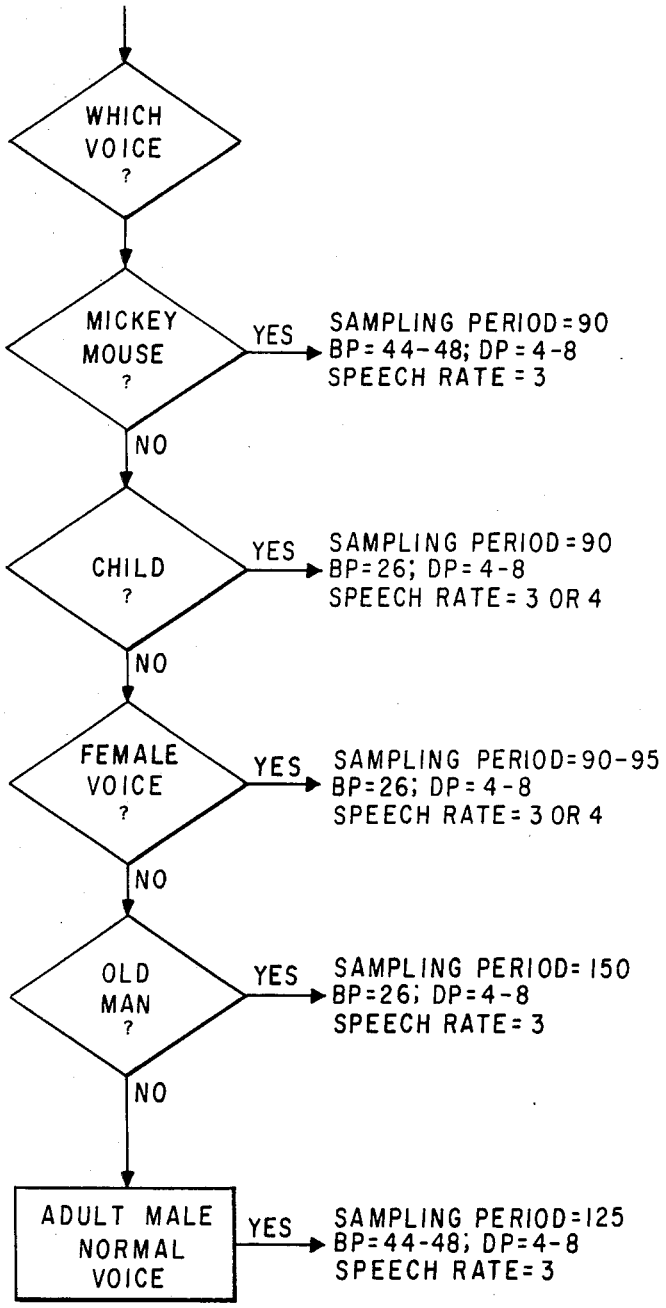
FIG. 10 is a flow chart illustrating voice characteristics conversion during allophone stringing of synthesized speech data.

By way of further explanation, the flow chart illustrated in FIG. 10 generally indicates how voice characteristics conversion in accordance with the present invention may be accomplished by an allophone stringer 36 or 36' (FIGS. 8 and 9). As shown in FIG. 10, five distinct voice sounds may be obtained from a single source of digital speech data from which audible synthesized speech may be derived. The examples given are based on data corresponding to that provided in Table II.

Figure 11:
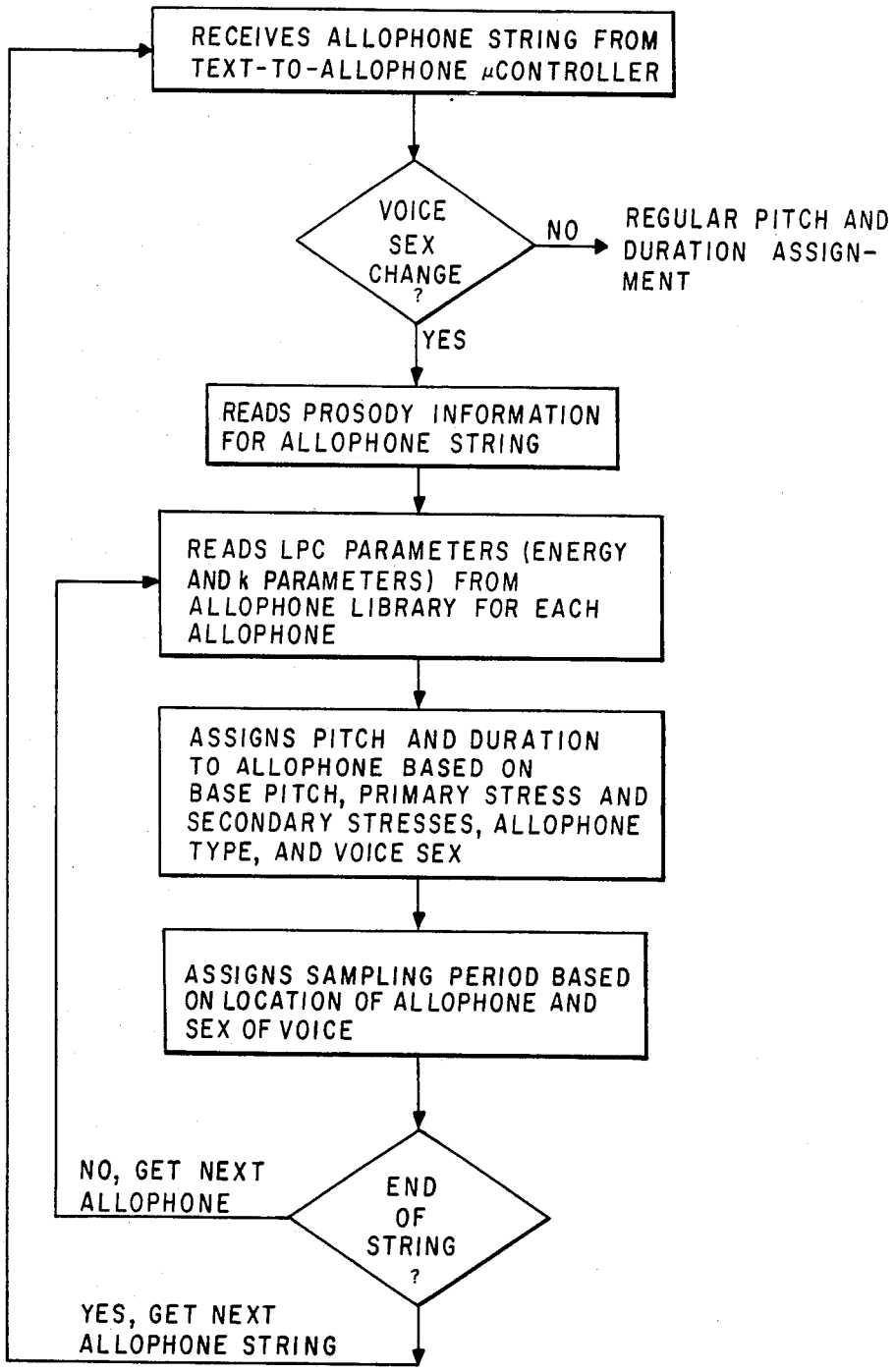
FIG. 11 is a flow chart illustrating the role of a microcontroller performing as an allophone stringer in a voice characteristics conversion of speech data suitable for producing audible synthesized speech from a male to female or female to male voice in a sophisticated aspect of the invention.

In accordance with the present invention, a method of linearly rescaling speech formants, pitch and duration to achieve the conversion of voice characteristics using an LPC speech synthesis system has been presented. It is contemplated that a more sophisticated technique may be adopted when changing between male and female voice sounds to enhance the degree of correlation between the female and male voice sounds for vowels in different groups. In the text-to-speech synthesis system disclosed in the aforementioned U.S. application Ser. No. 240,694 filed Mar. 5, 1981, the allophone stringer currently assigns pitch and duration at the allophone level. It is contemplated that the F-patterns (i.e. speech formants) per allophone could be rescaled in the manner described herein by controlling the sampling period at the allophone level, rather than at the phrase level. In this respect, different sampling periods would be required for different groups of allophones in the allophone library. For example, vowels are usually divided into high, low, front and back vowels such that at least four sampling periods should be selected in comprehending the vowel allophones in the conversion from male to female voice sounds, and vice versa. The flow chart of FIG. 11 generally defines the role that the allophone stringer plays during the conversion from a male to a female or female to male voice sounds.

Although preferred embodiments of the invention have been specifically described, it will be understood that the invention is to be limited only by the appended claims, since variations and modifications of the preferred embodiments will become apparent to persons skilled in the art upon reference to the description of the invention herein. Thus, it is contemplated that the appended claims will cover any such modifications or embodiments that fall within the true scope of the invention.

What we claim is:

1. A text-to-speech synthesis system for producing audible synthesized human speech of any one of a plurality of voice sounds simulating child-like, adult, aged and sexual characteristics from digital characters comprising:

text reader means adapted to be exposed to text material and responsive thereto for generating information signals indicative of the substantive content thereof;

converter means for receiving said information signals from said text reader means and generating digital character signals representative thereof;

means for receiving said digital character signals from said converter means;

memory means storing digital speech data including digital speech instructional rules and digital speech data representative of sound unit code signals;

data processing means for searching said digital speech data stored in said memory means to locate digital speech data representative of a sound unit code corresponding to said digital character signals received from said converter means;

speech memory means storing digital speech data representative of a plurality of sound units;

concatenating controller means operably coupled to said speech memory means for selectively combining digital speech data representative of a plurality of sound units in a serial sequence to provide concatenated digital speech data representative of a word;

speech synthesis controller means coupled to said data processing means and to said speech memory means for receiving digital speech signals representative of a sound unit code corresponding to said digital character signals and selectively accessing digital speech data representative of sound units corresponding to said sound unit code from said speech memory means;

speech synthesizer means operably coupled to said concatenating controller means and said speech synthesis controller means for receiving selectively accessed serial sequences of digital speech data from said concatenating controller means to provide audio signals corresponding thereto and representative of synthesized human speech;

voice characteristics conversion means interposed between said concatenating controller means and said speech synthesizer means and being coupled therebetween independently of the coupling between said concatenating controller means and said speech synthesizer means, said voice characteristics conversion means being operably coupled to said speech synthesis controller means and being responsive thereto to selectively modify the voice characteristics of said serially sequenced digital speech data output from said concatenating controller means, said voice characteristics conversion means including means for making a voice character selection of the synthesized speech to be derived from the digital speech data as selectively accessed from said speech memory means so as to simulate a voice sound differing in character with respect to the voice sound of the synthesized speech from the digital speech data of said speech memory means in the voice characteristics pertaining to the apparent age and/or sex of the speaker;

said digital speech data as selectively accessed from said speech memory means having a predetermined pitch period, a predetermined vocal tract model and a predetermined speech rate;

speech parameter control means for modifying the pitch period and speech rate in response to inputs from said voice character selection means to produce a modified pitch period and a modified speech rate, said speech parameter control means including sample rate control circuit means responsive to inputs from said voice character selection means for adjusting the sampling period of said digital speech data selectively accessed from said speech memory means in a manner altering the digital speech formants contained therein to a preselected degree and providing adjusted sampling period signals as an output;

speech data reconstructing means operably associated with said speech parameter control means for combining the modified pitch period and the modified speech rate with the predetermined vocal tract model into a synthesized speech data format of speech data modified with respect to the original speech data from said speech memory means;

said speech synthesizer means being coupled to said speech data reconstructing means and to the output of said sample rate control circuit means for receiving the modified speech data and the adjusted sampling period signals therefrom in providing said audio signals representative of human speech from the modified speech data; and audio means coupled to said speech synthesizer means for converting said audio signals into audible synthesized human speech in any one of a plurality of voice sound from said digital speech data stored in said speech memory means as determined by said voice characteristics conversion means.

2. A method of converting voice characteristics of synthesized speech to obtain modified synthesized speech of any one of a plurality of voice sounds simulating child-like, adult, aged and sexual characteristics from a single applied source of synthesized speech, said method comprising:

providing a source of synthesized speech in the form of digital speech data subject to speech synthesization using a predetermined sample period comprising a known number of task-accomplishing time increments;

adjusting the sampling period of the digital speech data from said source of synthesized speech in a manner altering the digital speech formants contained therein to a preselected degree;

producing modified digital speech data including the adjusted sampling period and having modified voice characteristics as compared to the synthesized speech from said source;

generating audio signals representative of human speech from the modified digital speech data; and converting said audio signals into audible synthesized human speech having different voice characteristics from the synthesized human speech which would have been obtained from said source of synthesized speech.

3. A method as set forth in claim 2, further including converting said modified digital speech data into digital speech data compatible with a speech synthesizer utilizing linear predictive coding speech synthesis; and directing the converted digital speech data into a linear predictive coding speech synthesizer in generating said audio signals representative of human speech.

4. A method as set forth in claim 2, wherein the sampling period associated with the digital speech data from said source of synthesized speech is adjusted by adding a predetermined number of time increments to the known number of time increments included in said sampling period to provide a new sampling period having a predetermined time duration greater than that of said sampling period associated with the synthesized speech from said source.

5. A method as set forth in claim 2, wherein the sampling period associated with the digital speech data from said source of synthesized speech is adjusted by varying the magnitude of each time increment defining said sampling period in a preselected manner such that the time duration of the adjusted sampling period is different from that of the original sampling period, but the total number of time increments defining said adjusted sampling period equals the known number of time increments defining said original sampling period.

6. A method of converting voice characteristics of synthesized speech to obtain modified synthesized speech of any one of a plurality of voice sounds simulating child-like, adult, aged and sexual characteristics from a single applied source of synthesized speech, said method comprising:

providing a source of synthesized speech as digital speech data including a predetermined pitch period, a predetermined vocal tract model, and a predetermined speech rate;

separating the pitch period, vocal tract model, and speech rate from each other to define said pitch period, vocal tract model, and speech rate as respective independent speech synthesis factors;

adjusting the sampling period associated with said digital speech data from said source of synthesized speech in a manner altering the digital speech formants contained therein to a preselected degree;

modifying the predetermined pitch period and the predetermined speech rate independently of each other and in respective response to the adjusted sampling period in a preselected manner to modify the voice characteristics of the synthesized speech from said source;

re-combining the modified pitch period, the modified speech rate, and the predetermined vocal tract model into a synthesized speech data format of digital speech data modified with respect to the synthesized speech from said source;

generating audio signals representative of human speech from the modified digital speech data in conjunction with the adjusted sampling period; and converting said audio signals into audible synthesized human speech having different voice characteristics from the synthesized human speech which would have been obtained from said source of synthesized speech.

7. A method as set forth in claim 6, further including converting said modified digital speech data into digital speech data compatible with a speech synthesizer utilizing linear predictive coding speech synthesis; and directing the converted digital speech data into a linear predictive coding speech synthesizer in generating said audio signals representative of human speech.

8. A method as set forth in claim 6, wherein the sampling period associated with the digital speech data from said source of synthesized speech is adjusted by adding a predetermined number of time increments to the known number of time increments included in said sampling period to provide a new sampling period having a predetermined time duration greater than that of said sampling period associated with the synthesized speech from said source.

9. A method as set forth in claim 6, wherein the sampling period associated with the digital speech data from said source of synthesized speech is adjusted by varying the magnitude of each time increment defining said sampling period in a preselected manner such that the time duration of the adjusted sampling period is different from that of the original sampling period, but the total number of time increments defining said adjusted sampling period equals the known number of time increments defining said original sampling period.

10. Apparatus for converting voice characteristics of synthesized speech to obtain modified synthesized speech of any one of a plurality of voice sounds simulating child-like, adult, aged and sexual characteristics from a single applied source of synthesized speech, said apparatus comprising:

voice character conversion controller means for receiving digital speech data from which synthesized speech may be derived from a source thereof, said digital speech data having a predetermined pitch period, a predetermined vocal tract model and a predetermined speech rate, said voice character conversion controller means having means for selecting digital speech data representative of at least a portion of a word, and means for making a voice character selection of the synthesized speech to be derived from the digital speech data received from said source simulating a voice sound differing in character with respect to the voice sound of the synthesized speech from said source in the voice characteristics pertaining to the apparent age and/or sex of the speaker;

speech parameter control means for modifying the pitch period and speech rate in response to inputs from said voice character conversion controller means as determined by said voice character selection means thereof to produce a modified pitch period and a modified speech rate;

speech data reconstructing means operably associated with said speech parameter control means for combining the modified pitch period and the modified speech rate with the predetermined vocal tract model into a synthesized speech data format of speech data modified with respect to the original speech data from said source;

speech synthesizer means coupled to said speech data reconstructing means for receiving the modified speech data therefrom and generating audio signals representative of human speech from the modified speech data; and audio means coupled to said speech synthesizer means for converting said audio signals into synthesized human speech having different voice characteristics from the synthesized speech which would have been obtained from the source of synthesized speech.

11. Apparatus as set forth in claim 10, wherein said digital speech data from the source is subject to speech synthesization using a predetermined sampling period comprising a known number of task-accomplishing time increments;

said speech parameter control means including sample rate control circuit means responsive to inputs from said voice character conversion controller means as determined by said voice character selection means thereof for adjusting the sampling period of said digital speech data from the source in a manner altering the digital speech formants contained therein to a preselected degree and providing adjusted sampling period signals as an output; and said speech synthesizer means being coupled to the output of said sample rate control circuit means for receiving said adjusted sampling period signals therefrom as the modified speech data from said speech data reconstructing means is being input thereto.

12. Apparatus as set forth in claim 11, wherein said speech synthesizer means is a linear predictive coding speech synthesizer.

13. Apparatus as set forth in claim 12, wherein said speech data reconstructing means includes parameter look-up means for converting said modified pitch period and said modified speech rate produced by said speech parameter control means into digital speech data compatible with said linear predictive coding speech synthesizer.

14. Apparatus as set forth in claim 11, wherein said sample rate control circuit means includes counter means operably connected to said voice character conversion controller means and being responsive thereto for establishing a preset count value, said counter means having a maximum count value at least equal to the preset count value, and clock means alternately enabling said speech synthesizer means and said counter means, said speech synthesizer means being idle during the time period said counter means is undergoing incremention from said preset count value to the maximum count value thereof.

15. Apparatus as set forth in claim 11, wherein said sample rate control circuit means comprises variable oscillator means operably connected to said voice character conversion controller means and said speech synthesizer means and being responsive to control signals from said voice character conversion controller means for selectively varying the magnitude of each time increment defining said sampling period in a preselected manner such that the time duration of the adjusted sampling period is different from that of the original sampling period, but the total number of time increments defining said adjusted sampling period equals the known number of time increments defining said original sampling period.

16. A speech synthesis system comprising:

memory means having digital speech data stored therein from which synthesized speech having predetermined voice characteristics may be derived;

speech synthesizer means operably connected to said memory means for receiving digital speech data therefrom to generate audio signals from which audible synthesized human speech may be provided;

controller means operably associated with said memory means and said speech synthesizer means for selectively accessing digital speech data from said memory means to be input to said speech synthesizer means;

voice characteristics conversion means interconnected between said memory means and said speech synthesizer means for modifying voice characteristics of the digital speech data selectively accessed from said memory means in response to said controller means; and audio means coupled to the output of said speech synthesizer means for converting said audio signals into audible synthesized human speech having different voice characteristics from the synthesized speech which would have been obtained from said digital speech data stored in said memory means.

17. A speech synthesis system as set forth in claim 16, wherein said digital speech data stored in said memory means comprises digital speech data representative of sound units; and further including concatenating controller means connected to said memory means and interposed between said memory means and said voice characteristics conversion means for stringing together sequences of digital speech data representative of allophones to define respective series of said digital speech data representative of words for input to said voice characteristics conversion means.

18. A speech synthesis system as set forth in claim 17, wherein said digital speech data representative of sound units stored in said memory means comprises digital speech formants;

said speech synthesizer means being a linear predictive coding speech synthesizer; and further including parameter look-up means interposed between said voice characteristics conversion means and said linear predictive coding speech synthesizer for converting the modified digital speech formants output from said voice characteristics conversion means to digital speech data including digital speech parameters representative of reflection coefficients for input to said linear predictive coding speech synthesizer.

19. A text-to-speech synthesis system for producing audible synthesized human speech from digital characters comprising:

means for receiving the digital characters;

speech unit rule means for storing encoded speech parameter signals corresponding to the digital characters;

rules processor means for searching the speech unit rule means to provide encoded speech parameter signals corresponding to the digital characters; and speech producing means connected to receive the encoded speech parameter signals and to produce audible synthesized human speech therefrom, said speech producing means including voice characteristics conversion means selectively operable to modify the voice characteristics of the encoded speech parameter signals corresponding to the digital characters such that said speech producing means is enabled to provide audible synthesized human speech of any one of a plurality of voice sounds.

20. A text-to-speech synthesis system for producing audible synthesized human speech of any one of a plurality of voice sounds simulating child-like, adult, aged and sexual characteristics from digital characters comprising:

text reader means adapted to be exposed to text material and responsive thereto for generating information signals indicative of the substantive content thereof;

converter means for receiving said information signals from said text reader means and generating digital character signals representative thereof;

means for receiving said digital character signals from said converter means;

memory means storing digital speech data including digital speech instructional rules and digital speech data representative of sound unit code signals;

data processing means for searching said digital speech data stored in said memory means to locate digital speech data representative of a sound unit code corresponding to said digital character signals received from said converter means;

speech memory means storing digital speech data representative of a plurality of sound units;

concatenating controller means operably coupled to said speech memory means for selectively combining digital speech data representative of a plurality of sound units in a serial sequence to provide concatenated digital speech data representative of a word;

speech synthesis controller means coupled to said data processing means and to said speech memory means for receiving digital speech signals representative of a sound unit code corresponding to said digital character signals and selectively accessing digital speech data representative of sound units corresponding to said sound unit code from said speech memory means;

speech synthesizer means operably coupled to said concatenating controller means and said speech synthesis controller means for receiving selectively accessed serial sequences of digital speech data from said concatenating controller means to provide audio signals corresponding thereto and representative of synthesized human speech;

voice characteristics conversion means interposed between said concatenating controller means and said speech synthesizer means and being coupled therebetween independently of the coupling between said concatenating controller means and said speech synthesizer means, said voice characteristics conversion means being operably coupled to said speech synthesis controller means and being responsive thereto to selectively modify the voice characteristics of said serially sequenced digital speech data output from said concatenating controller means; and audio means coupled to said speech synthesizer means for converting said audio signals into audible synthesized human speech in any one of a plurality of voice sounds from said digital speech data stored in said speech memory means as determined by said voice characteristics conversion means.

21. A method as set forth in claim 6, wherein said digital speech data as provided by said source of synthesized speech comprises digital speech data representative of sound units; and further including stringing together sequences of digital speech data modified with respect to the synthesized speech from said source as representive of sound units to define respective series of modified digital speech data representative of words from which said audio signals representative of human speech are generated.

22. A method as set forth in claim 21, wherein said sound units are allophones.

23. A method as set forth in claim 21, wherein said digital speech data representative of sound units comprises digital speech formants; and further including converting the modified digital speech formants into digital speech data including digital speech parameters representative of reflection coefficients; and directing the converted digital speech data including digital speech parameters representative of reflection coefficients into a linear predictive coding speech synthesizer in generating said audio signals representative of human speech.

24. A method as set forth in claim 23, wherein said sound units are allophones.

25. A speech synthesis system comprising:

memory means providing a source of synthesized speech as digital speech data stored therein from which synthesized speech having predetermined voice characteristics may be derived;

speech synthesizer means operably connected to said memory means for receiving digital speech data therefrom to generate audio signals from which audible synthesized human speech may be provided;

controller means operably associated with said memory means and said speech synthesizer means for selectively accessing digital speech data from said memory means to be input to said speech synthesizer means;

voice characteristics conversion means interconnected between said memory means and said speech synthesizer means for modifying voice characteristics of the digital speech data selectively accessed from said memory means in response to said controller means, said voice characteristics conversion means comprising means for making a voice character selection of the synthesized speech to be derived from the digital speech data received from said memory means as selectively accessed in response to said controller means to simulate a voice sound differing in character with respect to the voice sound of the synthesized speech from the digital speech data as selectively accessed from said memory means in the voice characteristics pertaining to the apparent age and/or sex of the speaker;

said digital speech data as accessed from said memory means having a predetermined pitch period, a predetermined vocal tract model and a predetermined speech rate;

speech parameter control means for modifying the pitch period and speech rate in response to inputs from said voice character selection means to produce a modified pitch period and a modified speech rate, said speech parameter control means including sample rate control circuit means responsive to inputs from said voice character selection means for adjusting the sampling period of said digital speech data as selectively accessed from said memory means in a manner altering the digital speech formants contained therein to a preselected degree and providing adjusted sampling period signals as an output;

speech data reconstructing means operably associated with said speech parameter control means for combining the modified pitch period and the modified speech rate with the predetermined vocal tract model into a synthesized speech data format of speech data modified with respect to the original speech data as selectively accessed from said memory means;

said speech synthesizer means being coupled to the output of said sample rate control circuit means for receiving said adjusted sampling period signals therefrom as the modified speech data from said speech data reconstructing means is being input thereto in generating said audio signals representative of human speech from the modified speech data; and audio means coupled to the output of said speech synthesizer means for converting said audio signals into audible synthesized human speech of any one of a plurality of voice sounds simulating child-like, adult, aged and sexual characteristics and having different voice characteristics from the synthesized speech which would have been obtained from said digital speech data stored in said memory means.

26. A speech synthesis system as set forth in claim 17, wherein said sound units are allophones.

27. A speech synthesis system as set forth in claim 18, wherein said sound units are allophones.

28. A text-to-speech synthesis system for producing audible synthesized human speech from digital characters comprising:

means for receiving the digital characters;

speech unit rule means for storing encoded speech parameter signals corresponding to the digital characters;

rules processor means for searching the speech unit rule means to provide encoded speech parameter signals corresponding to the digital characters and in the form of digital speech data from which synthesized speech having predetermined voice characteristics may be derived;

voice characteristics conversion means selectively operable to modify the voice characteristics of the encoded speech parameter signals corresponding to the digital characters and comprising means for making a voice character selection of the synthesized speech to be derived from the digital speech data as received from said rules processor means simulating a voice sound differing in character with respect to the voice sound of the synthesized speech from the digital speech data in the voice characteristics pertaining to the apparent age and/or sex of the speaker;

said digital speech data having a predetermined pitch period, a predetermined vocal tract model and a predetermined speech rate;

speech parameter control means for modifying the pitch period and speech rate in response to inputs from said voice character selection means to produce a modified pitch period and a modified speech rate, said speech parameter control means including sample rate control circuit means responsive to inputs from said voice character selection means for adjusting the sampling period of said digital speech data in a manner altering the digital speech formants contained therein to a preselected degree and providing adjusted sampling period signals as an output;

speech data reconstructing means operably associated with said speech parameter control means for combining the modified pitch period and the modified speech rate with the predetermined vocal tract model into a synthesized speech data format of speech data modified with respect to the original speech data as derived from said encoded speech parameter signals; and speech producing means coupled to said speech data reconstructing means for receiving the modified speech data therefrom and to produce audible synthesized human speech from the modified speech data as synthesized human speech of any one of a plurality of voice sounds simulating child-like, adult, aged and sexual characteristics and having different voice characteristics from the synthesized speech which would have been obtained from said encoded speech parameter signals as a source of synthesized speech.

29. A text-to-speech synthesis system as set forth in claim 20, wherein said sound units and said sound unit codes are allophones and allophonic codes.

* * * * *